United States Patent [19]

Baron et al.

[11] 4,221,531

[45] Sep. 9, 1980

[54] POWER SHOVEL HAVING IMPROVED FRONT END ASSEMBLY

[75] Inventors: George B. Baron; George J. Thompson; Michael M. Palm, all of Marion, Ohio

[73] Assignee: Dresser Industries, Inc., Dallas, Tex.

[21] Appl. No.: 950,001

[22] Filed: Oct. 6, 1978

[51] Int. Cl.[2] ..... E02F 3/32

[52] U.S. Cl. ..... 414/694; 414/722

[58] Field of Search ..... 414/694, 695, 722, 723, 414/727, 692, 709, 714, 700, 685, 707, 719, 687, 732, 733, 743, 738, 487; 37/1, 103, 117.5, 116, 118, 118 A, 126, 137; 212/57, 58 R, 59 R, 60, 144

[56] References Cited

U.S. PATENT DOCUMENTS

| | | | |
|---|---|---|---|
| 2,639,826 | 5/1953 | Welden | 414/732 |
| 3,080,076 | 3/1963 | Randall | 414/694 |
| 3,856,161 | 12/1974 | Baron | 414/694 |
| 4,046,270 | 9/1977 | Baron et al. | 414/694 |
| 4,085,854 | 4/1978 | Baron | 414/694 |

*Primary Examiner*—Frank E. Werner

*Attorney, Agent, or Firm*—Ward, Lalos, Leeds, Keegan & Lett

[57] ABSTRACT

A power shovel comprising a support unit: a stiffleg operatively connected to the support unit for pivotal movement about a stiffleg pivot axis, the stiffleg comprising a pair of transversely spaced, longitudinally disposed side beams each having an I-shaped cross-sectional configuration including upper and lower flange portions and an interconnecting web portion, a cross-piece section interconnecting the side beam sections and a web section interconnecting the web portions of the side beam sections; a handle operatively connected to the stiffleg for pivotal movement about a handle pivot axis; a dipper mounted on the handle; a crowd system operatively connected to the handle for crowding and retracting the dipper; and a hoist system for hoisting and lowering the dipper comprising at least one upper fluid actuated rod and cylinder assembly operatively connected at a lower end thereof to the stiffleg and operatively connected at an upper end thereof to the handle on one side of the handle pivot axis, at least one lower fluid actuated rod and cylinder assembly operatively connected at a lower end thereof to the stiffleg and operatively connected at an upper end thereof to the handle on a side opposite to the operative connection of the upper end of the upper fluid actuated assembly and the handle, relative to the handle pivot axis, and apparatus for selectively supplying fluid under pressure to opposite ends of the fluid actuated assemblies to effect an extension and retraction of the rods of the fluid actuated assemblies to correspondingly effect a pivotal movement of the handle about the handle pivot axis.

24 Claims, 4 Drawing Figures

POWER SHOVEL HAVING IMPROVED FRONT END ASSEMBLY

BACKGROUND OF THE INVENTION

This invention relates to power shovels and more specifically to a power shovel having an improved front end assembly. This invention particularly is applicable to large, heavy-duty mining shovels of the type disclosed in U.S. Pat. Nos. 3,501,034; 3,648,863 and 3,990,161.

In conventional, heavy-duty mining shovels, usually there is provided a lower frame provided with a propulsion unit, a rotatable upper frame mounted on the lower frame, a stiffleg operatively connected to the upper frame, a handle operatively connected to the stiffleg, a dipper mounted on the handle, a system for crowding the dipper and a system for hoisting the dipper. Typically, the hoist system of such type of shovel consists of a rope assembly, generally including a hoist drum mounted on the upper frame, driven by motor-generator sets through heavy-duty gear trains, sheaves mounted on the front end assembly of the machine and a rope wound on the hoist drum, reeved on the sheaves and dead-ended at the foot of the stiffleg. By paying out and taking in the hoist rope, the handle can be pivoted relative to the stiffleg to hoist and lower the dipper.

Hoist systems of the type described have several disadvantages. Initially, there are the original and replacement costs of the motor-generator sets, the heavy-duty gearing, the hoist drum, the sheaves and the ropes, which are substantial. Secondly, there is the disadvantage of the requirement for space of the hoist system components mounted on the upper frame. The motor-generator sets, gearing and hoist drum normally are mounted on the upper deck of the machine which usually is congested with other components of the machine including structural components of the housing and operator's cab, the crowd machinery, the swing machinery, the propulsion machinery and various auxiliary systems and equipment. Rope wear and fouling also are disadvantages of rope hoist systems which result in increased downtime for repair and maintenance. It thus has been found to be desirable to provide an improved front end assembly for power shovels, particularly for large, heavy-duty mining shovels, and specifically to provide an improved hoist system which would mitigate if not entirely eliminate the aforementioned disadvantages of rope systems.

In the normal operation of machines of the type described, in addition to normal tensile, compressive and bending loads being applied to the dipper which oridinarily are transmitted through the dipper, handle and stiffleg to the main frame of the machine, side loads are applied to the dipper and transmitted to the main frame of the machine which can be substantially detrimental to the machine. To counteract the detrimental effects of such side loads, it has been a practice in the prior art to utilize resilient joints in the handle or stiffleg which function to cushion such loads and to prevent the loads from being transmitted to the main frame of the machine. While being beneficial in cushioning side loads, such joints have certain disadvantages such as added cost and increased weight on the front end of the machine which increases horse power requirements and reduces the operating efficiency of the machine.

OBJECTS OF THE INVENTION

Accordingly, it is the principal object of the present invention to provide a novel power shovel having an improved front end assembly.

Another object of the present invention is to provide an improved front end assembly for large, heavy-duty mining shovels.

A further object of the present invention is to provide an improved front end assembly for a power shovel which will effectively carry loads in tension, compression, bending and torsion.

Another object of the present invention is to provide an improved front end assembly for power shovels eliminating the requirements of sheaves, ropes and resilient joints.

A further object of the present invention is to provide an improved front end assembly for a power shovel which avoids the traditional problems of rope wear and fouling.

A still further object of the present invention is to provide an improved front end assembly for a power shovel which reduces the static and dynamic loads imposed on the front end assembly of the shovel thus improving the stability and operating performance of the shovel.

A still further object of the present invention is to provide an improved front end assembly for a power shovel which is comparatively simple in design, relatively inexpensive to manufacture and easier to service.

BRIEF DESCRIPTION OF THE DRAWINGS

Other objects and advantages of the present invention will become more apparent to those persons having ordinary skill in the art to which the present invention pertains, from the following specification, taken in conjunction with the accompanying drawings wherein.

DESCRIPTION OF THE PREFERRED EMBODIMENT

Figure 1:
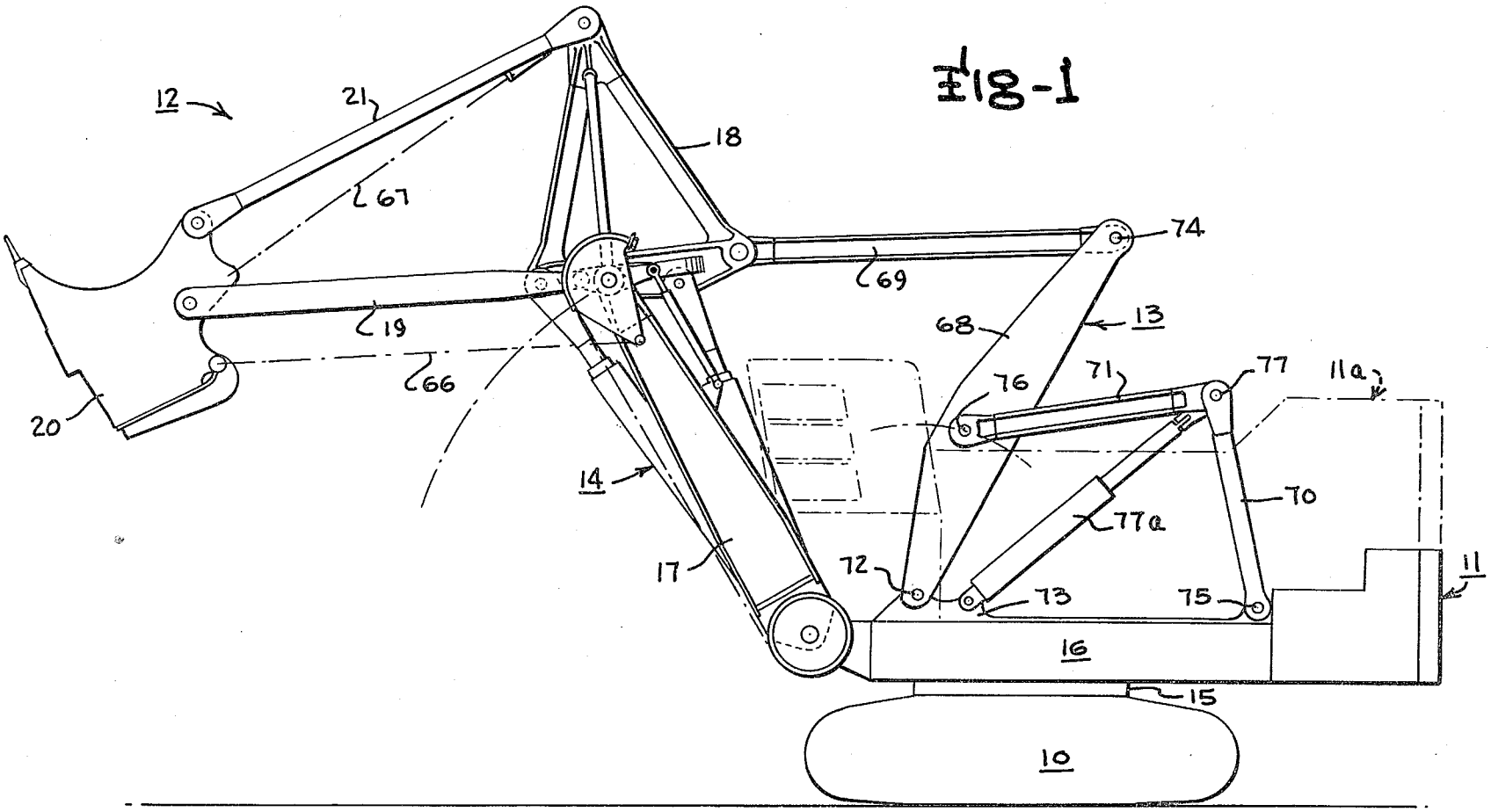
FIG. 1 is a side elevational view of a power shovel embodying the present invention.

Referring to the drawings, there is illustrated an embodiment of the invention which generally includes a crawler unit 10, a main support unit 11 mounted on the crawler unit, a front end assembly 12 mounted on the front end of the main support unit, a crowd system 13 mounted on the main support unit and operatively connected to the front end assembly, a hoist system 14 mounted on the front end assembly, and a system mounted on the main support unit for operating the crowd and hoist systems.

Crawler unit 10 consists of a lower frame supported on a pair of conventional crawler assemblies, and a conventional roller circle 15 mounted on the lower frame. Main support unit 11 consists of an upper frame 16 rotatably mounted on the roller circle and a housing **11*a*** mounted on the upper frame, which encloses certain components of the housing structure, the crowd system, the swing and propulsion machinery and other auxiliary systems and equipment.

Figure 2:
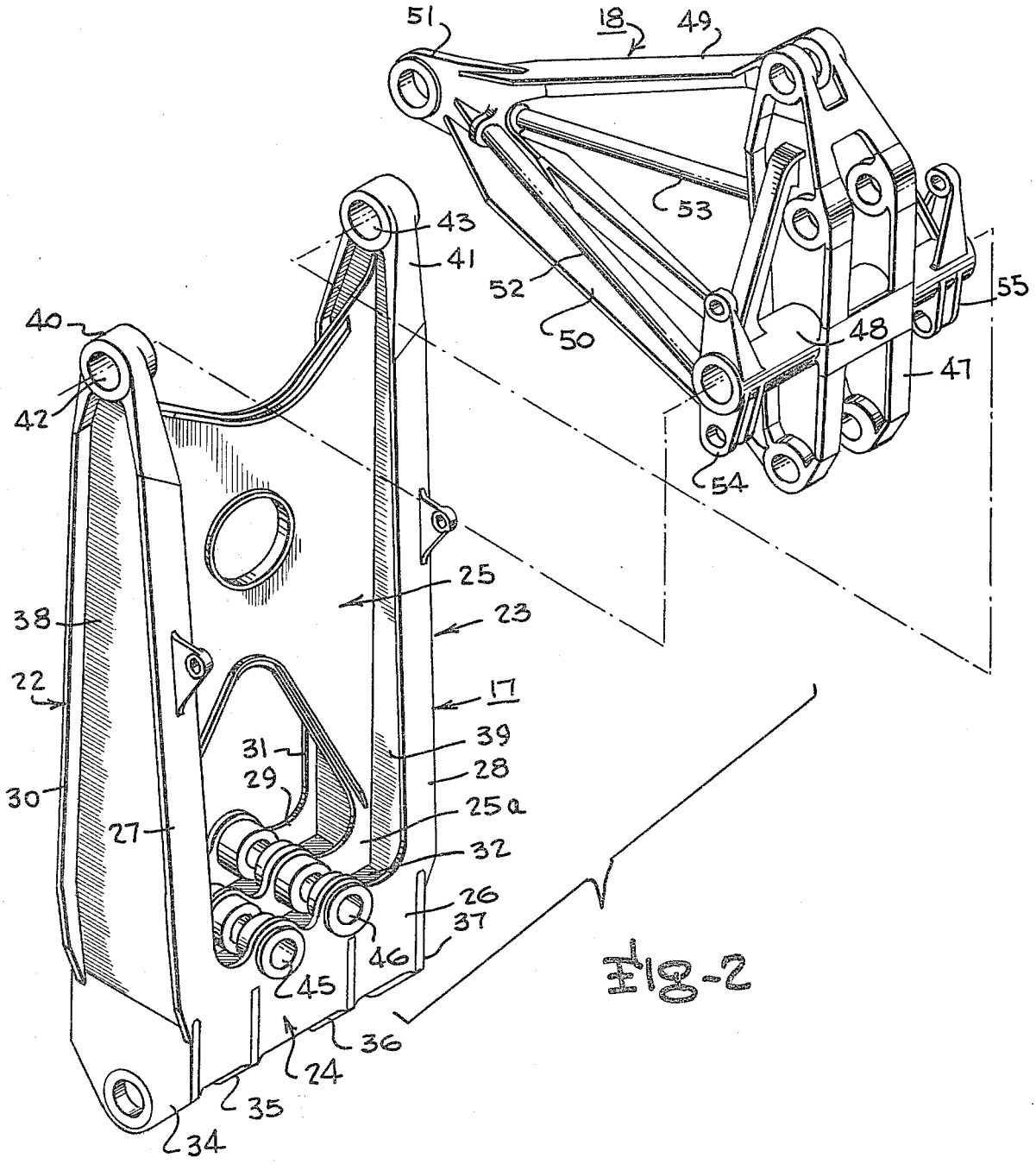
FIG. 2 is an enlarged, perspective view of a stiffleg and hoist frame comprising certain components of the invention.
Figure 3:
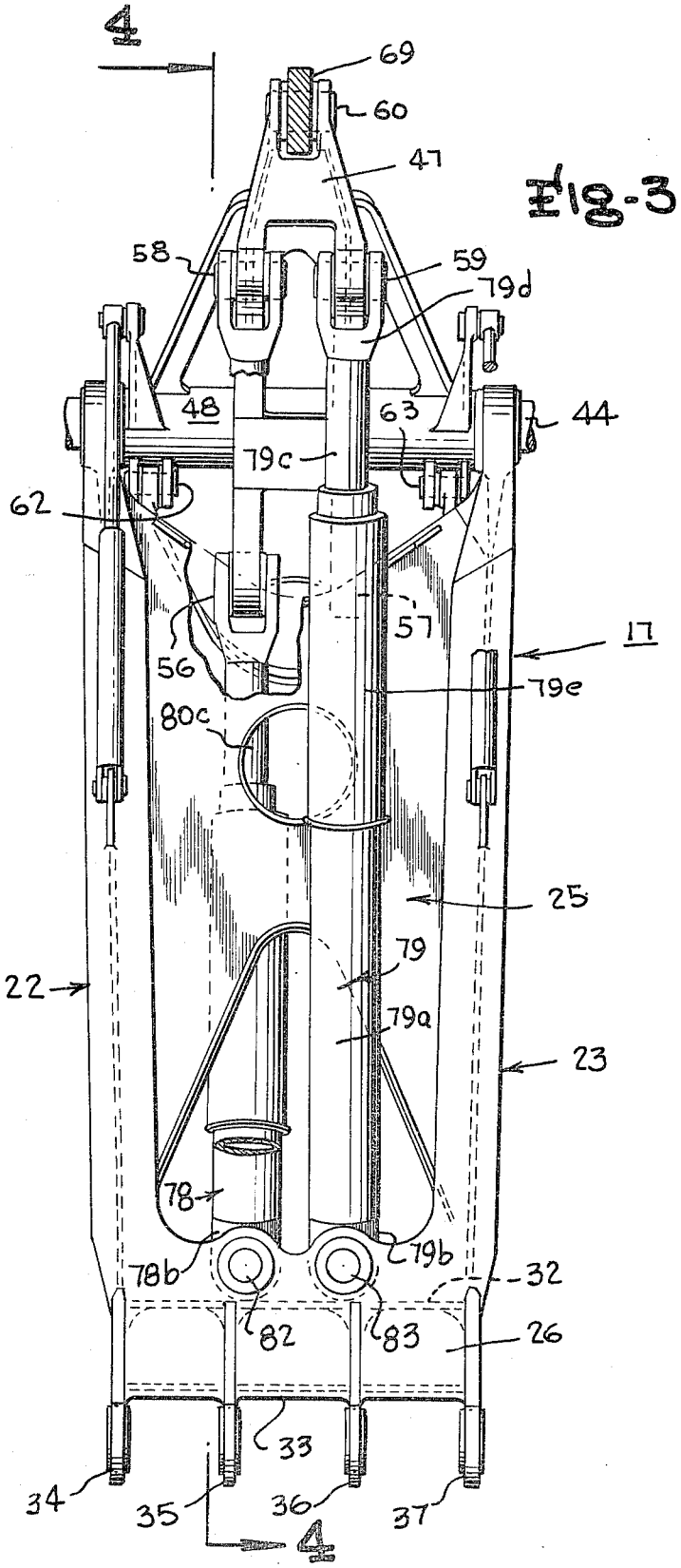
FIG. 3 is an enlarged, rear elevational view of the stiffleg and hoist frame shown in FIG. 1; and, FIG. 4 is a cross-section view taken along line 4—4 in FIG. 3.

Front end assembly 14 generally includes a stiffleg 17, a hoist frame 18, a dipper handle 19, a dipper 20 and a hoist link 21. As best illustrated in FIGS. 2 and 3, the stiffleg consists of a pair of transversely spaced, longitudinally disposed I-beam sections 22 and 23 joined together at their lower ends by a transversely disposed box beam section 24, forming a U-shaped structure, and a web section 25 interconnecting the I-beam sections above box beam section 24. Section 24 is provided with an upper plate member 26 which merges with upper flange portions 27 and 28 of I-beam sections 22 and 23, a lower plate member 2 which merges with lower flange portions 30 and 31 of I-beam sections 22 and 23, a front plate member 32 and a rear plate member 33. Formed integrally with box beam section 24 is a plurality of mounting brackets 34 through 37, provided with axially aligned openings, for pin mounting the foot of the stiffleg on the front end of the upper frame of the machine.

Web portions 38 and 39 of I-beam sections 22 and 23 are disposed substantially in longitudinal alignment with outer mounting brackets 34 and 37. The web portions also are interconnected by web section 25. The upper ends of the I-beam sections are formed with end portions 40 and 41 in which there are provided axially aligned openings 42 and 43 in which there is bearings for journalling a head shaft 44.

The forward ends of plate members 26 and 29 and web portion 25*a* are formed with two sets of bosses providing two sets of pin-receiving openings 45 and 46. As best illustrated in FIG. 3, it will be noted that the axes of pin-receiving openings 45 and 46 lie substantially in the same vertical planes as mounting brackets 35 and 36, respectively.

As best seen in FIG. 2, hoist frame 18 includes a bifurcated base section 47, a cylindrical mounting section 48 disposed intermediate the ends of and formed integrally with base section 47, a pair of upper and lower converging struts 49 and 50 formed integral at one set of ends thereof with the upper and lower ends of base section 47 and formed integrally at an opposite set of ends thereof with a head section 51, and a pair of struts 52 and 53 connected at a rearward set of ends thereof with the outer ends of cylindrical mounting section 48 and connected at a forward set of ends thereof with head section 51. The outer ends of mounting member 48 also are provided with depending sets of lugs 54 and 55.

Figure 4:
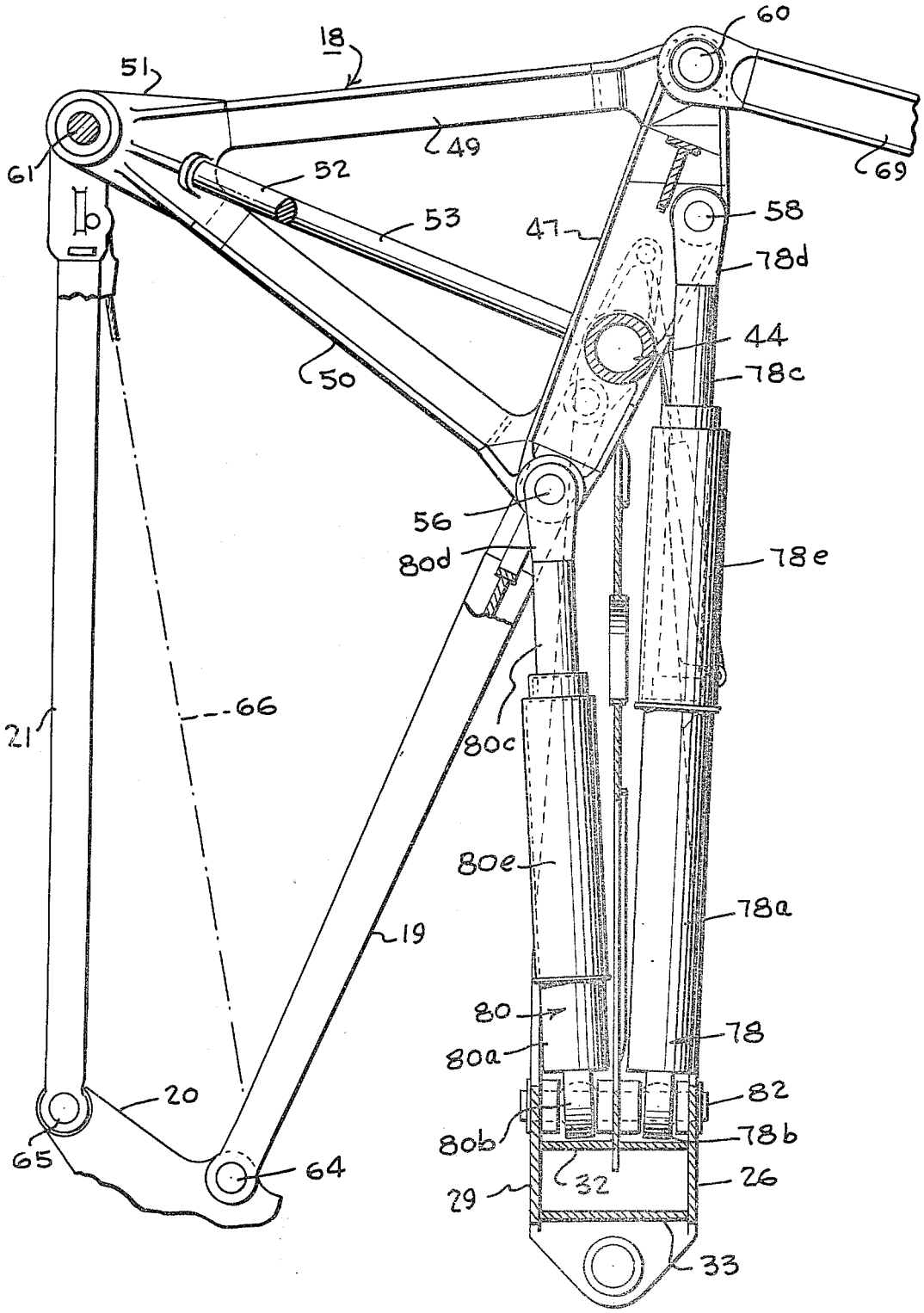

Hoist frame 18 is pivotally connected to the upper end of stiffleg 17 by means of head shaft 44 which is received in mounting section 48 and journaled at its ends in bearings provided in aligned openings 42 and 43 in the upper end of the stiffleg. As best shown in FIGS. 2, 3 and 4, the lower end of bifurcated base section 47 is formed with a pair of aligned openings provided with a pair of connecting pins 56 and 57. The upper portion of section 47, between mounting section 48 and the upper end of section 47, is formed with a pair of aligned openings provided with a set of connecting pins 58 and 59.

The upper end of base section 47 is provided with a bifurcated configuration having a pair of aligned openings for receiving a connecting pin 60. Head section 51 is provided with an opening for mounting a bearing for a connecting pin 61. The hoist frame further is provided with aligned openings in depending sets of lugs 54 and 55 which are provided with connecting pins 62 and 63.

Handle 19 consists of a suitable structural member and is provided with upper and lower bifurcated ends. The upper bifurcated end is connected to the hoist frame by means of pins 62 and 63, as best shown in FIG. 3. It will be noted that the axis of pins 62 and 63 is displaced radially relative to the axis of head shaft 44 so that the pivot axis of the handle relative to the hoist frame is displaced radially relative to the pivot axis of the hoist frame relative to the stiffleg. Such arrangement alleviates a congestion of components on the head shaft and reduces the bending forces on the head shaft, as is more fully described in U.S. Pat. No. 3,856,161. The lower bifurcated end of the stiffleg is pivotally connected to the upper rear end of dipper 20 by means of a pair of axially aligned pins 64.

Head section 51 of the hoist frame and the upper front end of dipper 20 are connected by hoist link 21. The upper end of the hoist link is bifurcated and connected to the head section of the hoist frame by means of connecting pin 1. The lower bifurcated end of the hoist link is connected to the dipper by means of a pair of axially aligned pins 65. As best illustrated in FIGS. 1 and 4, hoist frame 18, handle 19, dipper 20 and hoist link 21 are pivotally connected together to provide a four-bar linkage with the link comprising the hoist frame being pivotally connected to the upper end of the stiffleg by means of head shaft 44.

To provide a substantially flat pass of the dipper when it is crowded into a bank of material being excavated or loaded, there is mounted on the front end assembly a pitch control system 66, the construction and operation of which is fully described in U.S. Pat. Nos. 3,501,034 and 3,648,863. Furthermore, the front end assembly is provided with a pitch stop assembly 67, the construction and operation of which is fully described in U.S. Pat. No. 4,085,854.

The construction and operation of crowd system 13 is fully described in U.S. Pat. No. 4,046,270. Generally, it consists of a linkage arrangement and a fluid actuated system. Referring to FIG. 1, the linkage includes a mast 68, a connecting link 69, a pair of transversely spaced support links 70 and a pair of transversely spaced crowd drive links 71. Mast 68 consists of a pair of transversely spaced side sections pivotally connected at their lower ends by means of connecting pins 72 to mounting brackets 73 rigidly secured to the deck of upper frame unit 16, forwardly of the vertical center line of rotation of the upper frame, and cross-piece sections interconnecting the side sections between the upper and lower ends thereof. The forward end of connecting link 69 is pivotally connected to the upper end of hoist frame 18 by means of connecting pin 60. The rearward end of such link is connected to the upper end of mast 68 by means of a connecting pin 74. Support links 70 are pivotally connected at their lower ends to brackets rigidly secured to the deck of the upper frame unit by means of pins 75. The front ends of crowd drive links 69 are connected to mast 68 by means of connecting pins 76. The rear ends thereof are connected to the upper ends of support links 70 by means of pins 77 to provide a four-bar linkage arrangement consisting of the upper frame unit, the lower end of mast 68 crowd drive links 71 and support links 70.

Pivotally connected at their lower ends to the deck of the upper frame adjacent the lower end of mast 68 and pivotally connected at their upper ends to connecting pins 77 is a pair of fluid actuated rod and cylinder assemblies 77*a* which constitute components of the fluid actuating system. It will be appreciated that upon supplying fluid under pressure to opposite ends of the fluid actuated assemblies, the rods thereof will be extended and retracted to pivot support links 70 in vertical planes. The motion of support links 70 correspondingly will be transmitted through crowd drive links 71, mast 68 and connecting link 69 to the front end assembly of the machine consisting of the stiffleg, hoist frame, handle, dipper and hoist link to correspondingly crowd and retract the dipper.

Hoist system 14 consists of a pair of pull-type, hydraulically actuated rod and cylinder assemblies 78 and 79 operatively interconnecting the lower end of the stiffleg and an upper side of the hoist frame, a pair of push-type, hydraulically actuated rod and cylinder assemblies 80 and 81 (hidden behind assembly 80 in FIG. 4) operatively interconnecting the lower end of the stiffleg and a lower side of the hoist frame, and a suitable fluid supply system for supplying fluid under pressure to the cylinders of the assemblies. Assemblies 78 and 79 are substantially similar in construction, and assemblies 80 and 81 also are substantially similar in construction. Assembly 78 is provided with a cylinder portion 78*a* having a mounting fixture 78*b* on the free end thereof, a rod 78*c* slidably mounted in cylinder portion 78*a*, in the conventional manner, having a mounting fixture 78*d* mounted on the free end thereof, and a dust shield 78*e* mounted on the exposed end of rod portion 78*c*. Generally, dust shield 78*e* includes an annular end portion secured to the exposed end of rod portion 78*c* and a cylindrical portion secured to the annular portion thereof. The cylindrical portion of the dust shield has a length sufficient to overlie the juncture of the exposed portion of the rod and the cylinder for the full range of displacement of the rod relative to the cylinder so that during normal operation of the assembly, the dust shield will shield such juncture from the environment thus preventing contaminants from lodging on the rod and being carried into the cylinder. To further assure against the entry of contaminants between the dust shield and the cylinder, pressurized air may be injected into the dust shield which would be ejected through the annular space between the shield and the cylinder portion of the assembly, forming a pneumatic seal therebetween. Similarly, assembly 79 includes a cylinder portion 79*a* having a mounting fixture 79*b* mounted on the free end thereof, a rod portion 79*c* having a mounting fixture 79*d* mounted on the free end thereof and a dust shield 79*e* which functions in the same manner as dust shield 78*e*.

Actuating assemblies 78 and 79 are mounted on the upper side of stiffleg 17, between beam sections 22 and 23. The lower ends thereof are pivotally connected to section 26 of the stiffleg by means of mounting pins 82 and 83 journaled in bosses provided in section 26. As shown in FIG. 4, connecting pins 82 and 83 are provided with spherical bushings to permit limited universal movement of the lower ends of the actuating assemblies 78 and 79 relative to the connecting pins and the lower end of the stiffleg. The upper ends of the assemblies are pivotally connected to the hoist frame by means of connecting pins 58 and 59.

Actuating assemblies 80 and 81 also are similar in construction. Assembly 80 consists of a cylinder portion 80*a* having a mounting fixture 80*b* mounted on the free end thereof, a rod portion 80*c* having a mounting fixture 80*d* mounted on the free end thereof and a dust shield 80*e*. Assemblies 80 and 81 are mounted on the underside of the stiffleg, between beam sections 22 and 23. The lower ends of the assemblies are universally mounted on spherical bushings provided on connecting pins 82 and 83, and the upper ends thereof are connected to connecting pins 56 and 57 mounted at the lower end of base section 47 of the hoist frame.

Actuating assemblies 78 through 81 are of a single-acting type. The fluid supply system forming part of the hoist system can be of any suitable type which simultaneously will provide fluid under pressure to the cylinder ends of push-type assemblies 80 and 81 and to the rod ends of pull-type assemblies 78 and 79 to effect a hoisting motion of the dipper. It will be appreciaed that by supplying fluid under pressure to the cylinder ends of assemblies 80 and 81 and to the rod ends of assemblies 78 and 79, rods 80*c* and 81*c* will be caused to extend and rods 78*c* and 79*c* will be caused to retract to pivot the hoist frame and correspondingly the handle, dipper and hoist link about the axis of the head shaft to effect the hoist motion. While the embodiment described herein utilizes a combination of two equally-sized pull-type assemblies mounted on the upper side of the stiffleg and two equally-sized push-type cylinders mounted on the underside of the stiffleg to effect the hoisting motion, it is to be understood that any combination of numbers and sizes of cylinders can be used within the scope of the invention to provide the desired hoisting motion.

At the beginning of each digging cycle of the machine as described, the crowd system is operated to fully retract the front end assembly and the hoist system is operated to lower the dipper so that the dipper is positioned adjacent the lower end of the stiffleg. Suitable resilient pads are provided at the lower end of the stiffleg to prevent damage to the stiffleg by the dipper. To commence the operating cycle of the machine, the operator manipulates appropriate controls at the operator's station on the machine to permit fluid to flow from the cylinder ends of actuating assemblies 77*a* of the crowd system. Under such conditions, the weight of the front end assembly will cause the stiffleg to pivot forwardly, simultaneously crowding the dipper into the material being excavated or loaded. Simultaneously with the commencement of the crowding action of the dipper, appropriate controls are operated on the machine to effect limited hoisting motion of the dipper. This is accomplished by supplying fluid under pressure to the cylinder ends of push-type assemblies 80 and 81 of the hoist system and to the rod ends of pull-type cylinders 78 and 79. As the dipper is crowded into the bank of material being excavated or loaded, the combined crowding and hoisting action causes it to make a flat pass. At the same time, pitch control system 66 causes the pitch of the dipper to remain constant relative to the ground. At the end of the crowd phase of the cycle, the pitch control mechanism is released to cause the dipper to pitch upwardly and thus assure a full load of material in the dipper. The upward pitch of the dipper is restricted by pitch control system 67 in a manner as described in the aforementioned patent relating to such system.

After the dipper has been pitched upwardly, controls for the crowd and hoist systems and swing machinery are operated to position the dipper above the dump body of a hauling vehicle or another suitable repository for the material, where the door of the dipper is tripped to cause the door to open and the material to be unloaded. The desired retracting motion of the front end assembly is effected by supplying fluid under pressure to the cylinder ends of actuating cylinders 77*a* of the crowd system. Such action results in the extension of the rods of such assemblies to pivot the support links 70 rearwardly, simultaneously causing the front end to pivot rearwardly about the pivotal connection of the stiffleg to the upper frame of the machine. Accelerated hoisting motion is effected by increasing the flow of fluid to the cylinder ends of actuating assemblies 80 and 81 and the rod ends of actuating assemblies 78 and 79.

As soon as the material has been dumped, the swing machinery can be operated to rotate the front end of the machine back to the embankment, the crowd system can be operated to continue to retract the front end assembly and the fluid under pressure supplied to the hoist cylinders can be throttled down to permit the dipper handle to swing downwardly at a controlled rate until it again is positioned at the lower end of the stiffleg, ready to begin another operating cycle.

During the operating cycle of the machine as described, loads in tension, compression and bending imposed upon the dipper are transmitted through the dipper handle, the base portion of the hoist frame, the head shaft, the stiffleg and the foot pins into the upper frame of the machine. Side loads imposed on the dipper as when the dipper may be swung sideways into a large rock are translated through the dipper handle and stiffleg as torsional loads relative to the center line of the stiffleg. Such torsional loads are carried by the deflection or limbering action of the stiffleg thus diminishing, if not entirely eliminating, the transmission of such loads to the upper frame of the machine. Horizontal loads imposed on the front end assembly are resisted by web section 25 interconnecting the I-beam sections of the stiffleg.

The construction of the stiffleg particularly is well suited for carrying torsional loads imposed on the machine during the crowding phase of the digging cycle. Under torsional load, one I-beam section of the stiffleg is caused to bend upwardly and the other downwardly, thus producing a large torsional moment to be carried across between the side beam sections by lower connecting section of the stiffleg. By careful design of the side beam sections of the stiffleg, the upward and downward deflection of the I-beam sections can be made sufficient to allow a lateral movement of the dipper equal to about 3% of the length of the structure, without incurring unduly high stresses.

As a result of the use of side beams on the stiffleg having I-shaped cross-sectional configurations, and the omission of any heavy cross-pieces between the side beams except for a single cross-piece section at the lower ends of the side beam sections, the torsional deflection of the stiffleg under a given load is increased to a value which is comparable to that of a resilient joint as employed in the prior art for cushioning torsional loads, thereby eliminating the necessity of such a resilient joint which results in a more economical and efficient front end assembly. Because the stiffleg of the present invention is allowed to roll on its own axis, only a single crowd link is allowed, which may be provided with ball joint connections with the hoist frame and the upper end of the mast.

From the foregoing detailed description, it will be evident that there are a number of changes, adaptations and modifications of the present invention which fall within the province of those persons having ordinary skill in the art to which the present invention pertains. However, it is intended that all such variations not departing from the spirit of the invention be considered as within the scope thereof as limited solely by the appended claims.

We claim:

1. A power shovel comprising a support unit; a stiffleg operatively connected to said support unit for pivotal movement about a stiffleg pivot axis, said stiffleg comprising a pair of transversely spaced, longitudinally disposed side beams each having an I-shaped cross-sectional configuration including upper and lower flange portions and an interconnecting web portion, a cross-piece section interconnecting said side beam sections and a web section interconnecting the web portions of said side beam sections; a handle operatively connected to said stiffleg for pivotal movement about a handle pivot axis; a dipper mounted on said handle; a crowd system operatively connected to said handle for crowding and retracting said dipper; and a hoist system for hoisting and lowering said dipper comprising at least one upper fluid actuated rod and cylinder assembly operatively connected at a lower end thereof to said stiffleg and operatively connected at an upper end thereof to said handle on one side of said handle pivot axis, at least one lower fluid actuated rod and cylinder assembly operatively connected at a lower end thereof to said stiffleg and operatively connected at an upper end thereof to said handle on a side opposite to the operative connection of the upper end of said upper fluid actuated assembly and said handle, relative to said handle pivot axis, and means for selectively supplying fluid under pressure to opposite ends of said fluid actuated assemblies to effect an extension and retraction of the rods of said fluid actuated assemblies to correspondingly effect a pivotal movement of said handle about said handle pivot axis.

2. A power shovel according to claim 1 wherein the lower ends of said fluid actuated assemblies are connected to said stiffleg adjacent said stiffleg pivot axis.

3. A power shovel according to claim 1 wherein the upper ends of said fluid actuated assemblies are operatively connected to said handle adjacent said handle pivot axis.

4. A power shovel according to claim 1 wherein the lower ends of said fluid actuated assemblies are pivotally connected to said interconnecting cross-piece section.

5. A power shovel according to claim 1 wherein said interconnecting cross-piece section is disposed adjacent said stiffleg pivot axis.

6. A power shovel according to claim 5 wherein the lower ends of said fluid actuated assemblies are pivotally connected to said interconnecting cross-piece section.

7. A power shovel according to claim 1 wherein the interconnecting cross-piece section of said stiffleg is provided with upper and lower plate members merging with the flange portions of the side beam sections of said stiffleg.

8. A power shovel according to claim 7 wherein the lower ends of said fluid actuated assemblies are pivotally connected to the upper and lower plate members of the interconnecting cross-piece section of said stiffleg.

9. A power shovel according to claim 7 wherein said interconnecting cross-piece section of said stiffleg is provided with a plurality of lugs having pin-receiving openings for pivotally connecting the lower end of said stiffleg to said support unit.

10. A power shovel according to claim 7 wherein upper ends of said side beam sections of said stiffleg are provided with bearings, a head shaft is journaled in said bearings and said handle is operatively connected to said head shaft.

11. A power shovel comprising a support unit; a stiffleg operatively connected to said support unit for pivotal movement about a stiffleg pivot axis, said stiffleg comprising a pair of transversely spaced, longitudinally disposed side beams each having an I-shaped cross-sectional configuration including upper and lower flange portions and an interconnecting web portion, a cross-piece section interconnecting said side beam sections and a web section interconnecting the web portions of said side beam sections; a hoist frame operatively connected to said stiffleg for pivotal movement about a hoist frame pivot axis; a handle operatively connected to said hoist frame; a dipper mounted on said handle; a hoist link operatively interconnecting said hoist frame and dipper; a crowd system operatively connected to said hoist frame for crowding and retracting said dipper; and a hoist system for hoisting and lowering said dipper comprising at least one upper fluid actuated rod and cylinder assembly operatively connected at a lower end thereof to said stiffleg and operatively connected at an upper end thereof to said hoist frame on one side of said hoist frame pivot axis, at least one lower fluid actuated rod and cylinder assembly operatively connected at a lower end thereof to said stiffleg and operatively connected at an upper end thereof to said hoist frame on a side opposite to the operative connection of the upper end of said upper fluid actuated assembly and said hoist frame, relative to said hoist frame pivot axis, and means for selectively supplying fluid under pressure to opposite ends of said fluid actuated assemblies to effect an extension and retraction of the rods of said fluid actuated assemblies to correspondingly effect a pivotal movement of said hoist frame about said hoist frame pivot axis.

12. A power shovel according to claim 11 wherein the lower ends of said fluid actuated assemblies are connected to said stiffleg adjacent said stiffleg pivot axis.

13. A power shovel according to claim 11 wherein the upper ends of said fluid actuated assemblies are operatively connected to said hoist frame adjacent said hoist frame pivot axis.

14. A power shovel according to claim 11 wherein the lower ends of said fluid actuated assemblies are pivotally connected to said interconnecting cross-piece section.

15. A power shovel according to claim 11 wherein said interconnecting cross-piece section is disposed adjacent said stiffleg pivot axis.

16. A power shovel according to claim 15 wherein the lower ends of said fluid actuated assemblies are pivotally connected to said interconnecting cross-piece section.

17. A power shovel according to claim 1 wherein the interconnecting cross-piece section of said stiffleg is provided with upper and lower plate members merging with the flange portions of said side beam sections of said stiffleg.

18. A power shovel according to claim 17 wherein the lower ends of said fluid actuated assemblies are pivotally connected to the upper and lower plate members of the interconnecting cross-piece section of said stiffleg.

19. A power shovel according to claim 17 wherein said interconnecting cross-piece member of said stiffleg is provided with a plurality of lugs having pin-receiving openings for pivotally connecting the lower end of said stiffleg to said support unit.

20. A power shovel according to claim 11 wherein upper ends of said side beam sections of said stiffleg are provided with bearings, a head shaft is journaled in said bearings and said hoist frame is operatively connected to said head shaft.

21. A power shovel according to claim 1 wherein said interconnecting cross-piece section comprises a box beam.

22. A power shovel according to claim 21 wherein said interconnecting cross-piece section is disposed adjacent said stiffleg pivot axis.

23. A power shovel according to claim 21 wherein said interconnecting cross-piece section is provided with brackets to which the lower ends of said fluid actuated assemblies are pivotally connected.

24. A power shovel according to claim 21 wherein said interconnecting cross-piece section is provided with a plurality of lugs having pin-receiving openings for pivotally connecting the lower end of said stiffleg to said support unit.

* * * * *